US006406320B1

(12) United States Patent
Wu

(10) Patent No.: US 6,406,320 B1
(45) Date of Patent: Jun. 18, 2002

(54) ELECTRICAL CONNECTOR WITH LATCH

(75) Inventor: Jerry Wu, Pan-Chiao (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/837,002

(22) Filed: Apr. 17, 2001

(51) Int. Cl.[7] ..... H01R 13/173
(52) U.S. Cl. ..... 439/358; 439/567
(58) Field of Search ..... 439/350–358, 439/372, 567

(56) References Cited

U.S. PATENT DOCUMENTS 4,556,270 A * 12/1985 Schutzee et al. ..... 439/358
5,387,115 A * 2/1995 Kozel et al. ..... 439/567
5,727,970 A * 3/1998 Koguchi et al. ..... 439/358
6,210,219 B1 * 4/2001 Zhu et al. ..... 439/567

* cited by examiner

*Primary Examiner*—Hien Vu
(74) *Attorney, Agent, or Firm*—Wei Te Chung

(57) ABSTRACT

An electrical connector (10) includes an insulative housing (12), a number of electrical terminals (27) received in the insulative housing, a pair of latches (14) and a pair of boardlocks (26). The insulative housing has a pair of laterally spaced opposite end portions (12*a*) and a base (16). The latches are pivotally assembled to the base of the insulative housing. The boardlocks are retained to the opposite end portions of the insulative housing and each include a retaining leg bent to retain the latches.

4 Claims, 5 Drawing Sheets

ELECTRICAL CONNECTOR WITH LATCH

BACKGROUND OF THE INVENTION

1. Field of the Invention

The present invention generally relates to the art of electrical connectors and, more particularly, to a latch structure for latching an electrical connector to a complementary mating component.

2. Description of the Related Art

A pair of electrical connectors, such as male and female or plug and receptacle connectors, are often secured together in a mated condition by a latch structure of certain form. One type of the latch structure is a bail-type latch. A bail latch is a generally U-shaped wire formed somewhat as an elongated 180 degree loop defined by a pair of spaced leg portions with upper ends joined by a bight portion and lower ends pivotally mounted to the base of a connector housing.

The lower ends of the leg portions of each bail latch are respectively inserted through opposite sides of the insulative housing to be retained to a bottom of the insulative housing. The bottom of the insulative housing needs to form structures to correspond to the lower ends and the corresponding structures are somewhat complicated due to the wire structure of the bail latches. Furthermore, since the latches are only retained by the insulative housing and the latches and the housing are usually made from different materials, the latches are liable to escape from the insulative housing thereby making the latching of the mated connectors unreliable.

Therefore, an improved electrical connector is required to overcome the disadvantages of the prior art.

SUMMARY OF THE INVENTION

A major object of the present invention is to provide a structurally simplified electrical connector having a latch for latching the electrical connector to a complementary mating component.

An electrical connector in accordance with the present invention comprises an insulative housing, a plurality of electrical terminals, a pair of boardlocks and a pair of latches for latching to a complementary mating component. The insulative housing comprises a base, a pair of laterally spaced upstanding opposite sides, and a pair of longitudinally spaced opposite end portions. The boardlocks are inserted through the opposite end portions of the insulative housing to lock to a printed circuit board and, together with the base of the insulative housing, to retain the latches.

Other objects, advantages and novel features of the invention will become more apparent from the following detailed description of the present embodiment when taken in conjunction with the accompanying drawings.

DETAILED DESCRIPTION OF THE INVENTION

Figure 1:
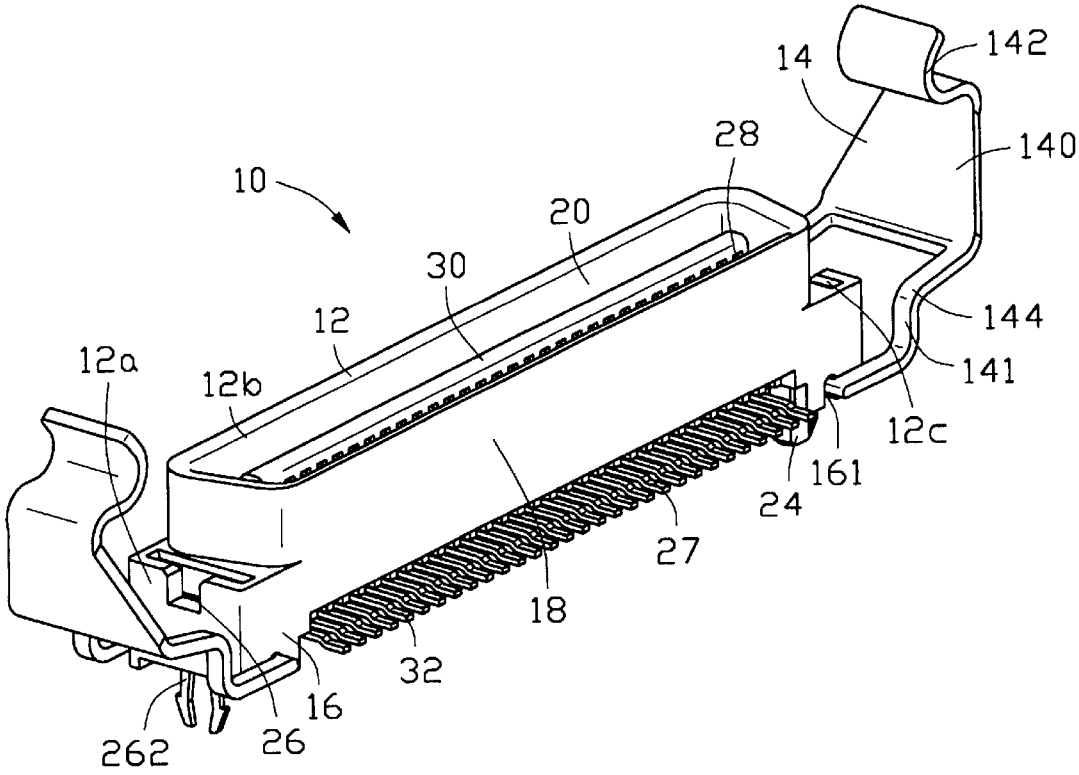
FIG. 1 is a perspective view of an electrical connector in accordance with the present invention.

Referring to FIG. 1, an electrical connector 10 in accordance with the present invention comprises an insulative housing 12, a plurality of electrical terminals 27, a pair of latches 14 and a pair of boardlocks 26.

The insulative housing 12 is a one-piece structure unitarily molded of dielectric material such as plastic or the like. The insulative housing 12 is elongated and includes longitudinally-spaced opposite end portions 12*a* and laterally-spaced opposite sides 12*b*. More particularly, the insulative housing 12 has a base 16 and an upstanding mating portion 18. The mating portion 18 is of a known D-shaped configuration and defines a D-shaped receptacle 20 for receiving a similarly shaped mating plug portion of a complementary mating connector. A tongue portion 30 projects into the receptacle 20. The electrical connector 10 is designed for mounting on a printed circuit board (not shown) with the base 16 of the electrical connector 10 mounted on a top surface of the printed circuit board. One or more polarizing posts 24 depend from the insulative housing 12 for insertion into appropriate mounting holes in the printed circuit board. Each end 12*a* defines a slit 12*c* extending vertically therethrough. The base 16 has a pair of laterally extending slots 161 recessed from a bottom face thereof and being located under the opposite end portions 12*a*, respectively.

The electrical terminals 27 are arranged in two rows lengthwise of the insulative housing 12. Each electrical terminal 27 has a contact portion 28 on either side of the tongue portion 30 of the insulative housing 12 and a tail portion 32 generally flush with the bottom of the base 16 of the insulative housing 12. The contact portions 28 are adapted for engaging appropriate terminals of a mating connector (not shown), and the tail portions 32 are adapted for surface connection, as by soldering, to circuit traces on the top surface of the printed circuit board.

Each latch 14 comprises an inwardly curved latching portion 142 for latching to a complementary component (not shown), a hollow-frame shaped assembling portion 144 and a transitional portion 140 therebetween. Each transitional portion 140 is a generally trapezoid-shaped plate with a width of an upper section thereof being less than a width of a lower section thereof. The latching portion 142 extends upwardly from the upper section of the transitional portion 140 and is generally rectangular shaped before being curved. The assembling portion 144 comprises a pair of spaced leg sections 141 extending downwardly from opposite sides of the lower section of the transitional portion 140 and a pivotal section 146 (FIG. 5) connecting the leg sections 141. The leg sections 141 are generally Z-shaped.

Figure 5:
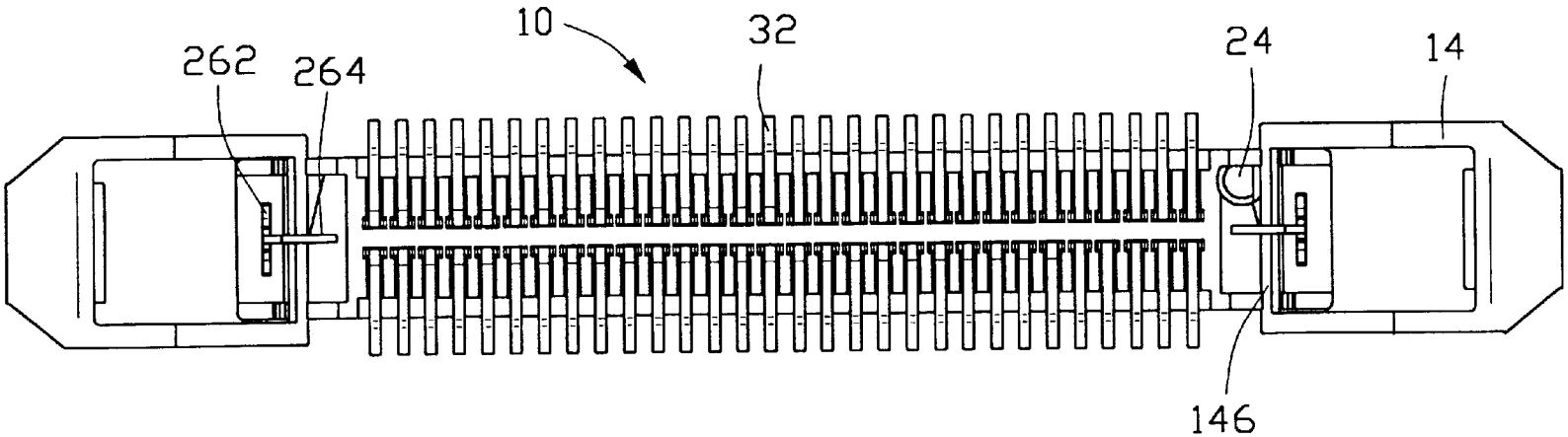
FIG. 5 is a bottom plan view of the electrical connector of FIG. 1.
Figure 6:
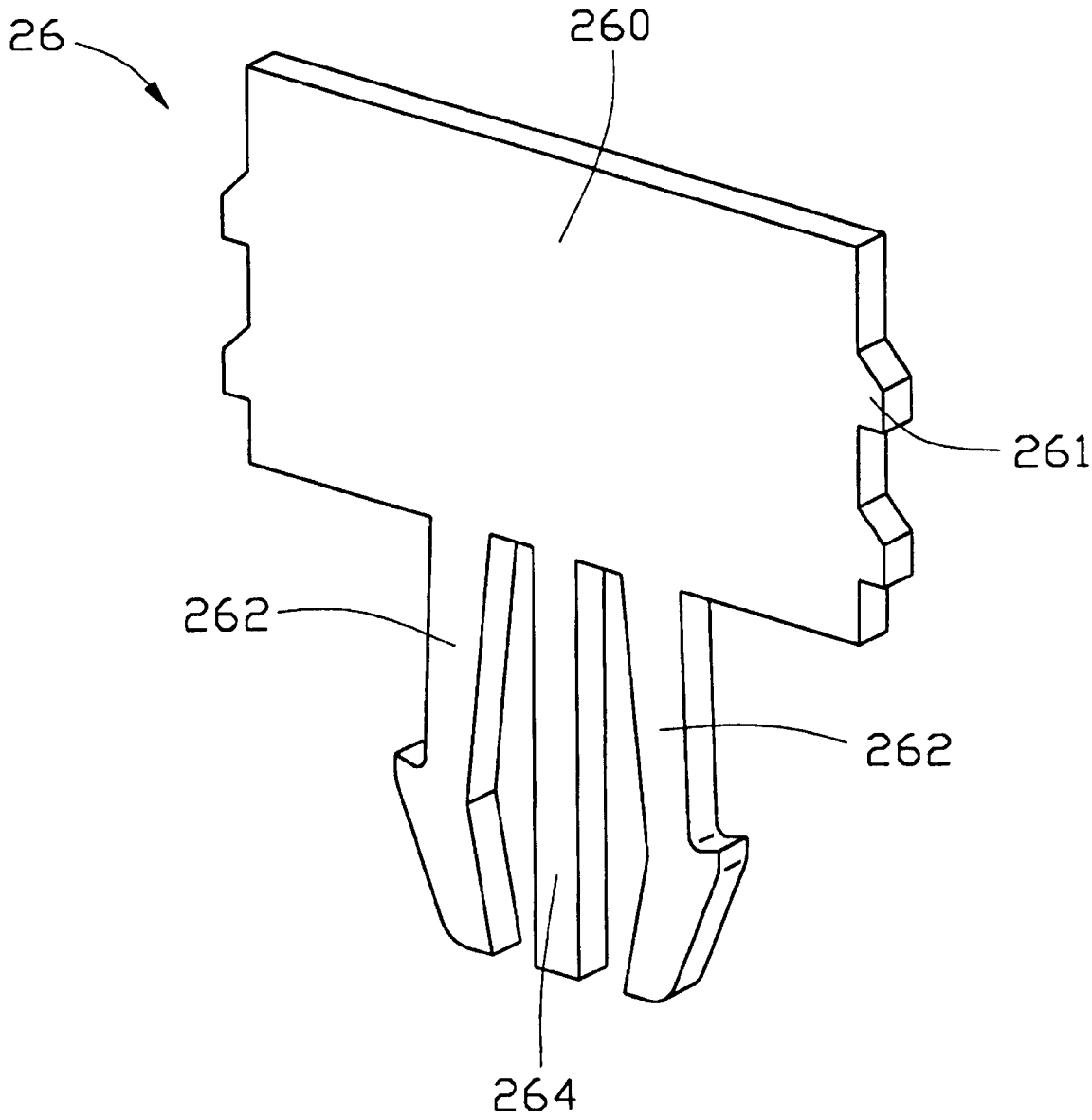
FIG. 6 is a perspective view of a boardlock of the electrical connector of FIG. 1 before it is bent.

Referring also to FIG. 6, each boardlock 26 comprises a body portion 260, a pair of spaced locking legs 262 depending downwardly from the body portion 260, and a retaining leg 264 depending downwardly from the body portion 260 and spaced from the locking legs 262. The body portion 260 comprises a plurality of retention barbs 261 on opposite sides thereof. Each retaining leg 264 is, as is shown in FIGS. 2–3 and 5–6, located between the locking legs 262, but as is obviously known to ordinary persons skilled in the pertinent art, this is unnecessary and the retaining leg 264 may be positioned beside both of the locking legs 262, if it is desired.

In assembly, the pivotal sections 146 of the latches 14 are received in the slots 161 of the base 16 of the insulative housing 12. The boardlocks 26 are inserted through the slits

Figure 2:
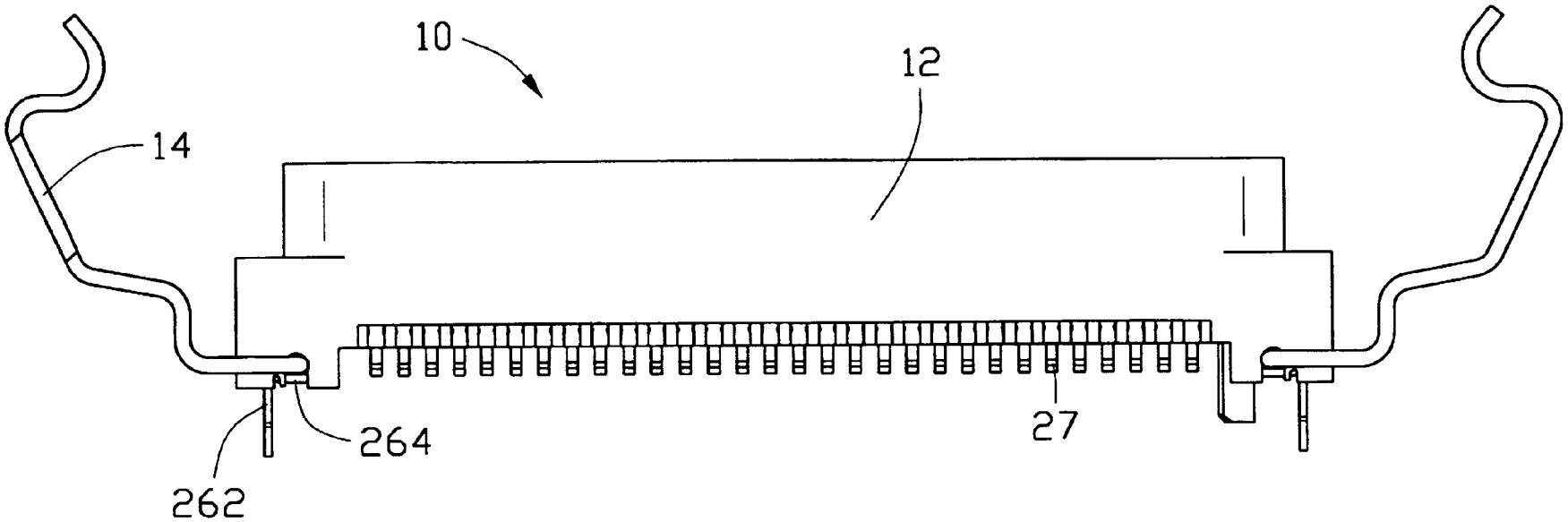
FIG. 2 is a front view of FIG. 1.
Figure 3:
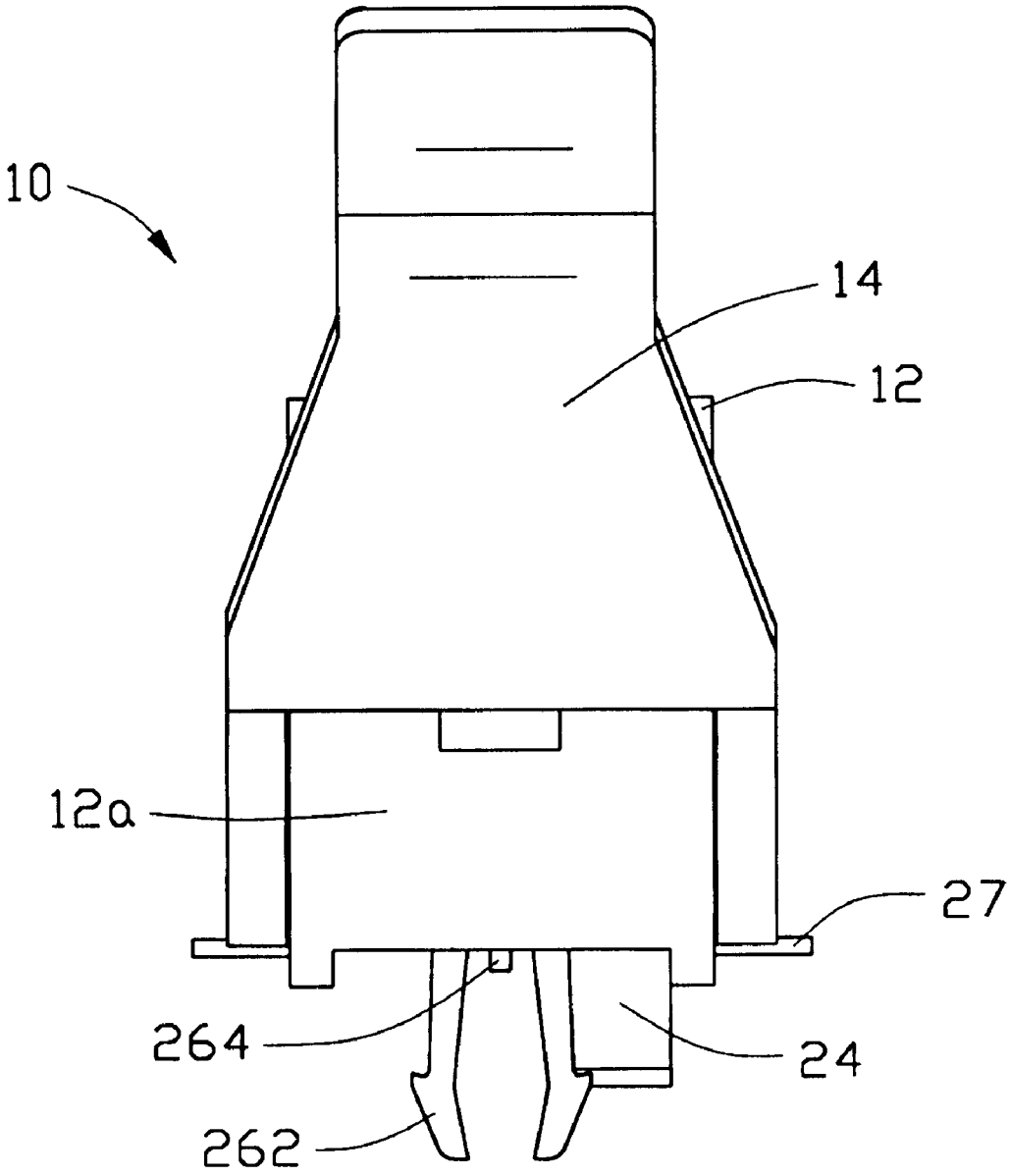
FIG. 3 is a side elevational view of FIG. 1.
Figure 4:
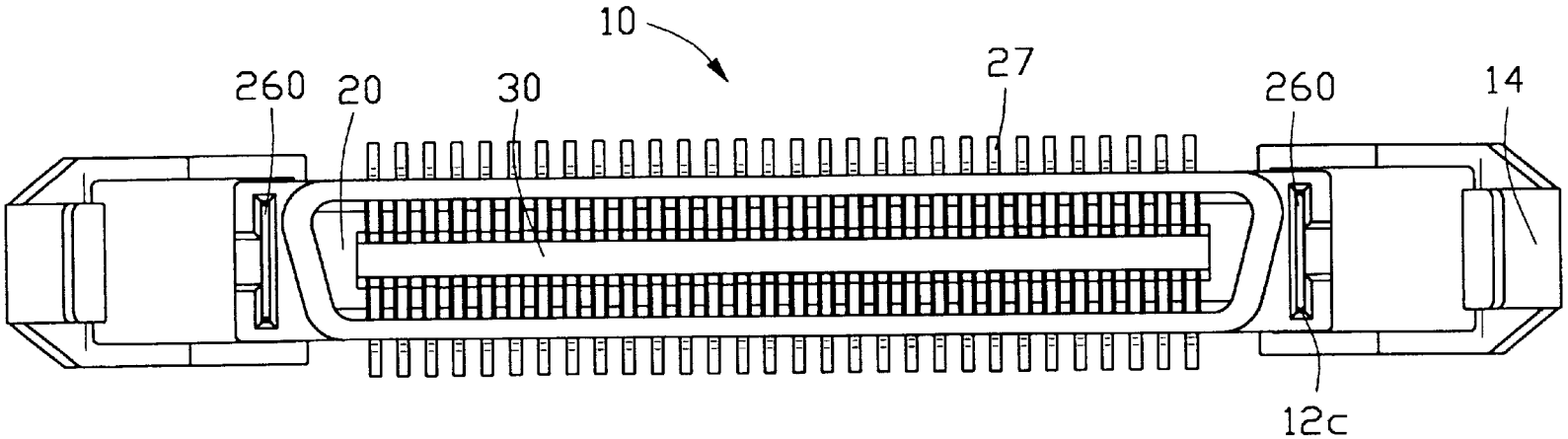
FIG. 4 is a top plan view of the electrical connector of FIG. 1.

12*c* of the insulative housing 12 with the body portion 260 being retained in the slits 12*c* and the retention barbs 261 providing a retention therebetween. The locking legs 262 and the retaining legs 264 extend downwardly beyond the insulative housing 12. Each retaining leg 264 is then, as shown in FIGS. 2, 3 and 5, bent to be perpendicular to the body portion 260 or to abut the bottom face of the base 16. The retaining legs 264 cross the slots 161 of the insulative housing 12, respectively, thereby restraining the latches 14 in the slots 161 from downwardly moving. The leg sections 141 of the assembling portions 144 of the latches 14 overlie opposite side surfaces of the opposite end portions 12*a* of the insulative housing 12 to prevent lateral movements of the latches 14, so that the latches 14 are only capable of pivotally moving about the pivotal sections 146 with respect to the insulative housing 12 in ways ordinarily known to persons skilled in the pertinent art to latch the electrical connector 10 to a complementary component and/or release the latching between the electrical connector 10 and the complementary component.

The latches 14 are pivotally retained by both the insulative housing 12 and the boardlocks 26, so structures of the insulative housing 12 are simplified and the retention of the latches 14 is reliable.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing comprising a base, longitudinally spaced apart opposite end portions and laterally spaced apart upstanding opposite sides;

a plurality of electrical terminals mounted in the insulative housing;

a pair of latches each comprising a latching portion adapted for latching to a complementary electrical component, a curved assembling portion and a transitional portion therebetween, the curved assembling portions being assembled to the base of the insulative housing; and a pair of boardlocks adapted for mounting to a printed circuit board, each boardlock having a body portion retained in corresponding end portion of the insulative housing, and a retaining leg extending from the body portion, the retaining legs retaining the assembling portions of the latches to the base; wherein each of the end portions of the insulative housing defines a slot recessed from a bottom face of the base, and the curved assembling portions of the latches each has a pivotal section received in the slot of the end portion and retained by the retaining leg; wherein each of said transitional portions is a trapezoid-shaped plate, and the latching portion extends upwardly from the upper section of the transitional portion and is generally inwardly curved; wherein the curved assembling portion comprises a pair of spaced leg sections extending from opposite sides of the lower section of each transitional portion and connected by the pivotal section, the leg sections of each assembling portion overlying opposite sides of the end portion.

2. The electrical connector as claimed in claim 1, wherein each boardlock comprises a pair of spaced locking legs extending from the body portion thereof and spaced from the retaining leg thereof, the retaining leg being perpendicular to both the body portion and the locking legs.

3. An electrical connector comprising:

an insulative housing defining a base with a plurality of terminals therein, said base defining a slot recessed from a surface;

a latch pivotally attached to said housing, said latch including an inwardly curved latching portion at an upper end and a curved assembling portion at a lower end, said curved assembling portion including a pair of legs moveable beside the base and a pivotal section received within said slot and transversely integrally bridging said pair of legs; and a board lock attached to the base for locking the connector to a printed circuit board on which the connector is seated, said board lock comprising a pair of spaced locking legs extending from a body portion thereof and spaced from a retaining leg thereof, the retaining leg being perpendicular to the locking logs and latchably engaged with the pivotal section of the latch for preventing the pivotal section from being dropped from the slot so as to retain the latch in position.

4. The connector as claimed in claim 3, wherein said slot extends uninterruptedly through the housing, and said pivotal section extends through said slot uninterruptedly.

* * * * *